US011338165B2

(12) United States Patent
Hume et al.

(10) Patent No.: US 11,338,165 B2
(45) Date of Patent: May 24, 2022

(54) MULTIPLE MOVEMENT EXERCISE DEVICE

(71) Applicant: HIGH STREET TV (GROUP) LIMITED, North Yorkshire (GB)

(72) Inventors: Josh Hume, West Yorkshire (GB); Luke Modeste, North Yorkshire (GB)

(73) Assignee: HIGH STREET TV (GROUP) LIMITED, North (GB)

( * ) Notice: Subject to any disclaimer, the term of this patent is extended or adjusted under 35 U.S.C. 154(b) by 0 days.

(21) Appl. No.: 16/480,994

(22) PCT Filed: Jan. 24, 2018

(86) PCT No.: PCT/EP2018/051630
§ 371 (c)(1),
(2) Date: Jul. 25, 2019

(87) PCT Pub. No.: WO2018/138103
PCT Pub. Date: Aug. 2, 2018

(65) Prior Publication Data

US 2020/0001127 A1 Jan. 2, 2020

(30) Foreign Application Priority Data

Jan. 25, 2017 (GB) ..... 1701222

(51) Int. Cl.
*A63B 21/00* (2006.01)
*A63B 21/068* (2006.01)
(Continued)

(52) U.S. Cl.
CPC ..... *A63B 21/00054* (2013.01); *A63B 21/068* (2013.01); *A63B 23/0458* (2013.01);
(Continued)

(58) Field of Classification Search
CPC ..... A63B 21/00054; A63B 21/068; A63B 23/0458; A63B 23/1227; A63B 2023/006;
(Continued)

(56) References Cited

U.S. PATENT DOCUMENTS 4,200,282 A * 4/1980 Agyagos ..... A63B 17/00 482/147
4,319,749 A * 3/1982 Agyagos ..... A63B 22/14 482/147
(Continued)

FOREIGN PATENT DOCUMENTS

CN 102836524 A 12/2012
CN 203137678 U 8/2013
(Continued)

OTHER PUBLICATIONS

International Search Report and Written Opinion, dated Apr. 20, 2018, from corresponding PCT application No. PCT/EP2018/051630.
(Continued)

*Primary Examiner* — Joshua Lee
*Assistant Examiner* — Catrina A Letterman
(74) *Attorney, Agent, or Firm* — Nixon & Vanderhye

(57) ABSTRACT

An exercise device for allowing multiple exercise movements is provided. The device includes a substantially cube-shaped frame, and a unit for doing exercise movements on at least one side of the frame.

12 Claims, 2 Drawing Sheets

Figure 1A:
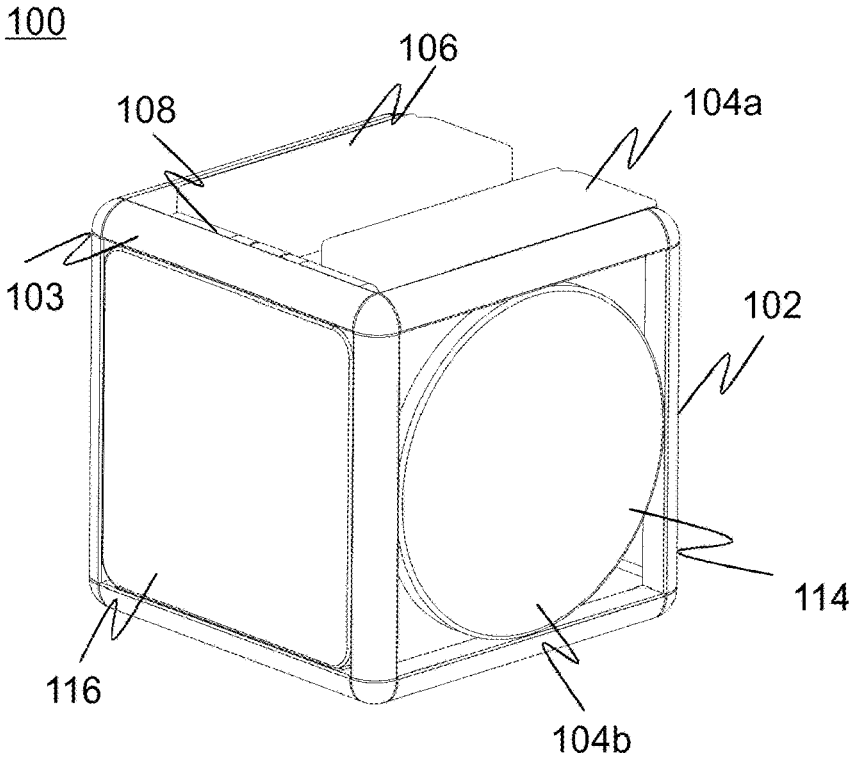

(51) Int. Cl.
*A63B 23/04* (2006.01)
*A63B 23/12* (2006.01)
*A63B 23/00* (2006.01)

(52) U.S. Cl.
CPC ..... *A63B 23/1227* (2013.01); *A63B 2023/006* (2013.01); *A63B 2023/0411* (2013.01); *A63B 2225/093* (2013.01)

(58) Field of Classification Search
CPC ..... A63B 2023/0411; A63B 2225/093; A63B 21/00047; A63B 2208/0204; A63B 2208/0223; A63B 2208/0233; A63B 2208/0247; A63B 2208/0252; A63B 2208/0257; A63B 2208/028; A63B 2210/50; A63B 2225/09; A63B 23/1236; A63B 22/14; A63B 23/0211; A63B 23/0216; A63B 23/0238; A63B 23/0355; A63B 23/0494; A63B 23/1218; A63B 3/00; A63B 5/16; A63B 21/4034; A63B 21/4035; A63B 17/00; A63B 22/04; A63B 22/18; A63B 2022/0074; A63B 22/0064
See application file for complete search history.

(56) References Cited

U.S. PATENT DOCUMENTS

| | | | | |
|---|---|---|---|---|
| 4,673,179 | A | 6/1987 | Pengler | |
| 5,660,257 | A * | 8/1997 | Douglas | A45C 15/00 190/1 |
| 6,273,841 | B1 * | 8/2001 | Johnston | A63B 21/015 482/131 |
| 6,280,361 | B1 * | 8/2001 | Harvey | A63B 21/025 482/101 |
| 6,676,579 | B1 | 1/2004 | Lin | |
| 7,309,303 | B1 | 12/2007 | Proctor | |
| 7,922,624 | B1 | 4/2011 | Fairhurst et al. | |
| 8,820,522 | B2 * | 9/2014 | Quarry | A45C 5/04 206/315.1 |
| 9,320,939 | B1 * | 4/2016 | Hyslop | A63B 71/0009 |
| 10,226,662 | B1 * | 3/2019 | Mink | A63B 17/00 |
| 2007/0270292 | A1 * | 11/2007 | Laney | A63B 21/4035 482/121 |
| 2011/0124476 | A1 | 5/2011 | Holley | |
| 2011/0294623 | A1 | 12/2011 | Alessandri et al. | |
| 2013/0137558 | A1 | 5/2013 | Ross | |
| 2013/0172160 | A1 | 7/2013 | Poole | |
| 2013/0274078 | A1 | 10/2013 | Andrews | |
| 2014/0221182 | A1 * | 8/2014 | Lin | A63B 21/0004 482/142 |
| 2015/0273263 | A1 | 10/2015 | Guttman | |
| 2017/0100622 | A1 * | 4/2017 | Wall | A63B 21/4029 |
| 2018/0133538 | A1 * | 5/2018 | Jones | A63B 21/0602 |
| 2018/0236298 | A1 * | 8/2018 | Donnelly | B65D 21/0204 |
| 2019/0126122 | A1 * | 5/2019 | Vester | A63B 21/4029 |

FOREIGN PATENT DOCUMENTS

| | | | |
|---|---|---|---|
| DE | 202007015126 | U1 | 2/2008 |
| EP | 0213611 | A2 | 3/1987 |
| EP | 2389987 | A1 | 11/2011 |
| GB | 2526530 | A | 12/2015 |
| JP | S60-177861 | U | 11/1985 |
| JP | H06-312031 | A | 11/1994 |
| JP | 2003-220101 | A | 8/2003 |
| KR | 20-0379865 | Y1 | 3/2005 |
| KR | 101284092 | B1 | 7/2013 |

OTHER PUBLICATIONS

GB Search Report, dated Apr. 3, 2017, from corresponding GB Application No. GB1701222.0.
CN Office Action, dated Oct. 16, 2018, from corresponding CN Application No. 201890000023.4.
CN Office Action, dated Jan. 4, 2019, from corresponding CN Application No. 201890000023.4.
Examination Report issued in UK Patent Application No. GB1701222.0 dated Nov. 28, 2019.
Office Action issued in Japanese Patent Application No. 2019-560479 dated Dec. 21, 2021.

* cited by examiner

MULTIPLE MOVEMENT EXERCISE DEVICE

FIELD OF THE INVENTION

Generally, the present invention relates to exercise equipment. In particular, the present invention pertains to exercise devices allowing multiple exercise movements.

BACKGROUND

Exercise and fitness has become quite a trend. High intensity interval training or HIIT, a particular form of exercising, has also become popular. The idea is to engage in an exercise that quickly increases heart rate. Such exercises are usually performed in intervals mixing short periods of high-intensity and low-intensity workouts. HIIT workouts have become popular as one may carry out an efficient workout in a short period of time, for example in less than 30 min.

A wide variety of different exercise devices exist today. There are several different exercise devices for home and gym use. Devices for home use need to be compact so that they do not take up too much storage space. However, most devices today are large and cumbersome and require a lot of (storage) space at home.

Another problem that a home exerciser faces is that the devices for home use often only provide exercise for one single movement. A stepper device allows you to engage in stepping exercises, a balance board allows balancing exercises, a push-up stand only allows for push-up exercises and so on.

On the other hand, if a home exerciser acquires many different types of exercise equipment, he/she will end up with many different devices that take a lot of space at home. Also, purchasing many different exercise devices may become costly for a home exerciser.

Today, there does not exist a feasible compact solution that simultaneously allows the user/exerciser to engage in multiple different exercise movements.

SUMMARY OF THE INVENTION

The objective is to at least alleviate the problems described hereinabove not satisfactorily solved by the known arrangements, and to provide a feasible exercise device that allows multiple exercise movements with one device. Another objective is to provide an exercise device that is compact. A third objective is to provide an exercise device allowing efficient (HIIT) workouts.

The aforesaid objective is achieved by the embodiments of an exercise device in accordance with the present invention.

The aforesaid objective(s) are achieved in accordance with the present invention.

Accordingly, in one aspect of the present invention, an exercise device for allowing multiple exercise movements comprises

- a substantially cube-shaped frame, and
- means for doing exercise movements on at least one side of the frame.

In one embodiment, a plurality of bars form at least partially edges of the frame.

In another, either supplementary or alternative, embodiment, the device comprises different means on at least two sides of the frame for different exercise movements. In some embodiments, the device comprises at least three or four different means on the sides of the device for different exercise movements.

In a further, either supplementary or alternative, embodiment, the cube-shaped frame is a fixed frame.

In a further, either supplementary or alternative, embodiment, the cube-shaped frame is rotatable to at least two sides of the frame, allowing to do exercise movements on the at least two sides of the frame.

In a further, either supplementary or alternative, embodiment, least one of the means on one side of the frame comprises at least two rods for allowing a grip of the rods for exercise movements such as push-up and/or dip movements.

In a further, either supplementary or alternative, embodiment, the rods are attachable/detachable for allowing exercise movements with the rods, such as biceps, triceps and/or shoulder movements.

In a further, either supplementary or alternative, embodiment, at least one of the means on one side of the frame comprises a stepper for stepping exercise movements.

In a further, either supplementary or alternative, embodiment, at least one of the means on one side of the frame comprises a twist board for twist exercise movements.

In a further, either supplementary or alternative, embodiment, at least one side of the frame comprises a flat surface for plyometric exercises.

In a further, either supplementary or alternative, embodiment, the flat surface is attachable/detachable, wherein the flat surface comprises a curved bottom part such that the flat surface can be used as a balance board.

In a further, either supplementary or alternative, embodiment, the exercise device comprises a cover such that exercise device can be used as furniture such as a foot stool or side table. In one embodiment, the cover is made of fabric/textile.

The utility of the present invention follows from a plurality of factors depending on each particular embodiment. The device may allow multiple different exercise movements with one single device. The device may be a compact space-saving solution. The device may be a cost-saving solution. The device may allow efficient high intensity interval training (HIIT). The device may be durable, tolerating heavy use.

The expression "a number of" refers herein to any positive integer starting from one (1), e.g. to one, two, or three.

The expression "a plurality of" and "multiple" refers herein to any positive integer starting from two (2), e.g. to two, three, or four.

Different embodiments of the present invention are disclosed in the dependent claims.

BRIEF DESCRIPTION OF THE RELATED DRAWINGS

Next the invention is described in more detail with reference to the appended drawings in which FIG. 1*a* illustrates an isometric view of an embodiment of an exercise device in accordance with the present invention.

Figure 1B:
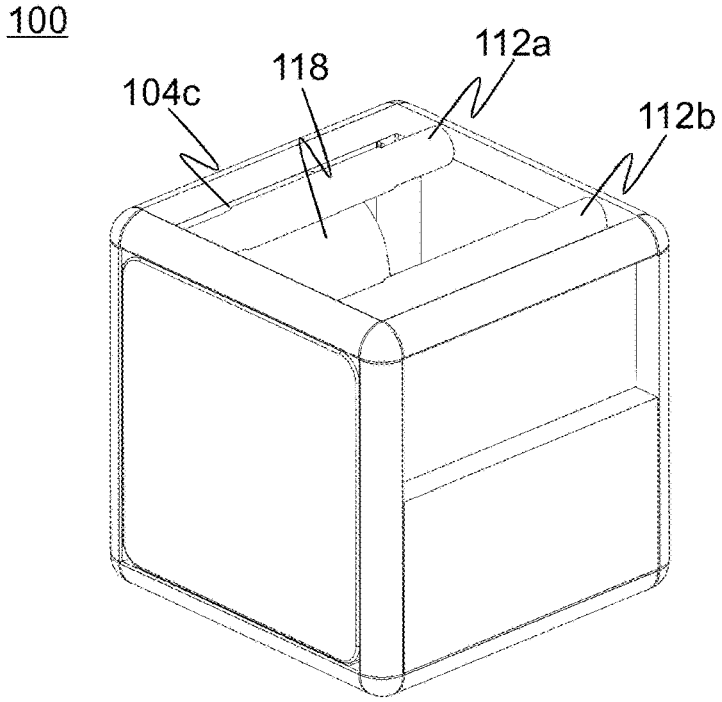

FIG. 1*b* illustrates another isometric view of an embodiment of an exercise device in accordance with the present invention.

Figure 2A:
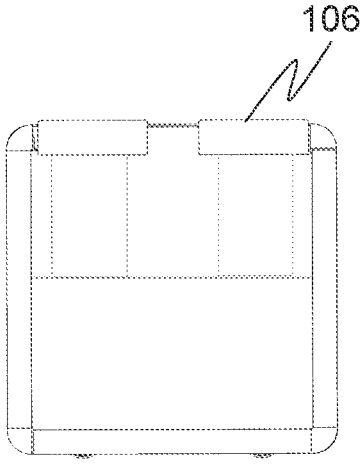

FIG. 2*a* illustrates a front view of an embodiment of an exercise device in accordance with the present invention.

Figure 2B:
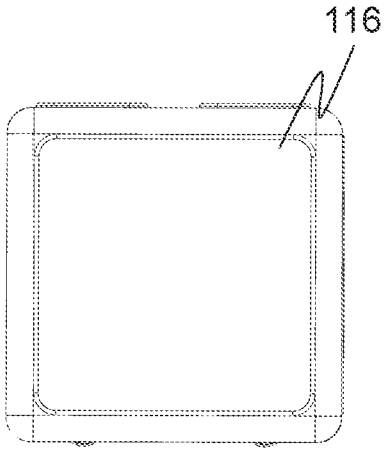

FIG. 2*b* illustrates a back view of an embodiment of an exercise device in accordance with the present invention.

Figure 2C:
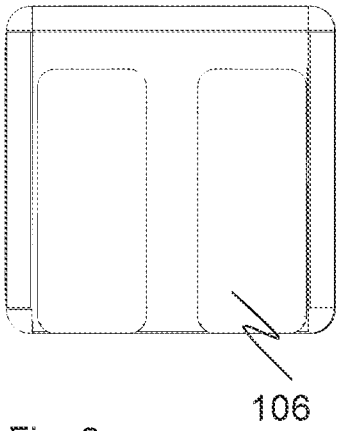

FIG. 2*c* illustrates a top view of an embodiment of an exercise device in accordance with the present invention.

Figure 2D:
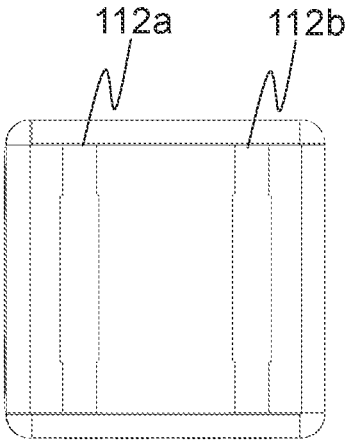

FIG. 2*d* illustrates a bottom view of an embodiment of an exercise device in accordance with the present invention.

Figure 2E:
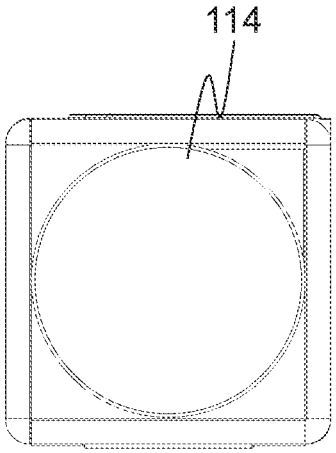

FIG. 2*e* illustrates a left view of an embodiment of an exercise device in accordance with the present invention.

Figure 2F:
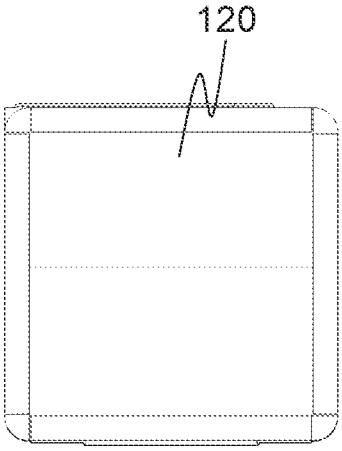

FIG. 2*f* illustrates a right view of an embodiment of an exercise device in accordance with the present invention.

DETAILED DESCRIPTION OF THE EMBODIMENTS

Referring to FIGS. 1*a* and 1*b*, the exercise device 100 comprises a substantially cube-shaped frame 102. Preferably the frame 102 is cube-shaped. However, in alternative embodiments, the frame may diverge from a cubic shape. For example, one side of the cube may be smaller than the others or two sides may be tilted, the shape thereby diverging from a complete cubic shape.

The expression "substantially cube-shaped frame" refers herein to any hexahedron (i.e. a polyhedron comprising six faces) wherein each face is a quadrilateral (i.e. a polygon with four edges) wherein the angle between two edges is preferably more than 70 degrees and less than 110 degrees, more preferably more than 90 degrees and less than 100 degrees, and most preferably more than 85 degrees and less than 95 degrees (measured within the quadrilateral). One edge of the frame is preferably 15-100 cm, more preferably 20-70 cm and most preferably 25-50 cm.

The frame 102 comprises a plurality of bars 103 that form the cubic shape of the frame. The bars are preferably plastic. Alternatively, the bars are steel or other rigid material. The bars 103 preferably form at least partially the edges of the cube-shaped frame. The frame structure comprises additional supportive structure such as bars and/or plates within the frame for strengthening the structure and/or for means 104*a*, 104*b*, 104*c* to attach to. Bars and/or plates within the frame may attach to the bars forming the cube-shaped frame.

The exercise device 100 comprises means 104*a*, 104*b*, 104*c* on the sides of the frame that allows different exercise movements with the device. Each of the means provides a functionality that allows the user to perform exercise movements with the device. The frame 104 may be rotated to different sides so that the different means 104*a*, 104*b*, 104*c* may be used for exercising.

One side of the device 100 comprises a stepper 106 for allowing stepping movement exercises with the device. The backside of the stepper can be viewed in FIG. 2*a* and the top of the stepper in FIG. 2*c*. The front part 108 of the stepper is attached to the frame 102. One of the frame bars 103 may be left out on the backside of the stepper for allowing room for the stepping movement, for example.

One side of the device 100 comprises two rods 112*a*, 112*b* such that the user can take a grip around the rods and do push-ups or dips with the rods, for example. The rods may also be attachable/detachable such that the rods can be used separately for exercise movements such as triceps, biceps and/or shoulder movements. The rods may comprise weight, such as 1 kg or 2 kg. The top view of the rods 112*a*, 112*b* is illustrated in FIG. 2*d*.

One side of the device 100 comprises a twist board 114 for twist movement exercises. The user may stand on the twist board and rotate/twist his/her body. A tube part extends from the back of the twist board. The tube part is arranged on a rod such that the twist board can rotate. A top view of the twist board is illustrated in FIG. 2*e*.

One side of the device 100 comprises a flat surface 116 for allowing plyometric exercises with the device such as steps and/or jumps onto the device. The flat surface 116 comprises a curved bottom part 118. The flat surface is attachable/detachable such that the surface may be used separately as a balance board. The flat surface 116 is also illustrated in FIG. 2*b*.

FIG. 2*f* illustrates a cover side 120 of the exercise device.

As is understood by a skilled person, the means for doing exercise movements may in some embodiments extend beyond the ones presented in this disclosure. The means presented in this disclosure, mainly a stepper, rods, twist board and flat surface are presented as exemplary, not limiting, embodiments.

Consequently, a skilled person may on the basis of this disclosure and general knowledge apply the provided teachings in order to implement the scope of the present invention as defined by the appended claims in each particular use case with necessary modifications, deletions, and additions.

The invention claimed is:

1. An exercise system for allowing multiple exercise movements, the exercise system comprising:

a substantially cube-shaped frame comprising a plurality of sides, the cube-shaped frame being rotatable to at least two sides of the plurality of sides of the cube-shaped frame that are used for exercise such that the at least two sides of the cube-shaped frame are configured to be used for exercise upon rotation of the cube-shaped frame to the respective sides, the plurality of sides comprising at least two faces; and at least two exercise devices respectively provided on the at least two sides of the cube-shaped frame that are used for exercise, the at least two exercise devices being configured such that the exercise movements are able to be performed using the at least two exercise devices on the at least two sides of the cube-shaped frame, one of the at least two exercise devices being a twist board for twist exercise movements and provided on one of the at least two faces of the cube-shaped frame, another one of the at least two exercise devices that is different from the twist board being a stepper for step exercise movements and provided on at least another face of the at least two faces of the cube-shaped frame.

2. The exercise system according to claim 1, wherein a plurality of bars at least partially form edges of the cube-shaped frame.

3. The exercise system according to claim 2, wherein the cube-shaped frame is a fixed frame.

4. The exercise system according to claim 2, wherein at least one of the exercise devices on one of the at least two sides of the cube-shaped frame comprises at least two rods configured to receive a grip thereon for exercise movements.

5. The exercise system according to claim 1, wherein the cube-shaped frame is a fixed frame.

6. The exercise system according to claim 1, wherein at least one of the exercise devices on one of the at least two sides of the cube-shaped frame comprises at least two rods configured to receive a grip thereon for exercise movements.

7. The exercise system according to claim 6, wherein the rods are attachable/detachable and configured to allow exercise movements with the rods.

8. The exercise system according to claim 1, wherein at least one of the at least two faces of the cube-shaped frame comprises a flat surface for plyometric exercises.

9. The exercise system according to claim 8, wherein the flat surface is attachable/detachable, and wherein the flat surface comprises a curved bottom part.

10. The exercise system according to claim 1, further comprising a cover such that the exercise device is configured to be used as furniture.

11. The exercise system according to claim 10, wherein the cover is made of textile/fabric.

12. The exercise system according to claim 1, wherein the cube-shaped frame is a cube.

* * * * *